United States Patent [19]

D'Alessandro

[11] Patent Number: 4,726,606

[45] Date of Patent: Feb. 23, 1988

[54] POCKET PAGE HOLDER

[76] Inventor: James G. D'Alessandro, 69 Pinewood Dr., Hamilton Square, N.J. 08690

[21] Appl. No.: 823,024

[22] Filed: Apr. 4, 1986

[51] Int. Cl.[4] ..... B42D 9/00
[52] U.S. Cl. ..... 281/42; 281/45
[58] Field of Search ..... 281/42, 45

[56] References Cited

U.S. PATENT DOCUMENTS

| | | | |
|---|---|---|---|
| 1,569,986 | 1/1926 | Kurtzeborn | 281/42 |
| 1,934,528 | 11/1933 | Faries | 281/42 |
| 3,737,178 | 6/1973 | Tjernlund | 281/42 |
| 4,474,383 | 10/1984 | Kikis | 281/45 |

FOREIGN PATENT DOCUMENTS

| | | | |
|---|---|---|---|
| 0278845 | 3/1913 | Fed. Rep. of Germany | 281/42 |
| 0239960 | 3/1946 | Switzerland | 281/42 |

*Primary Examiner*—Howard N. Goldberg
*Assistant Examiner*—Taylor J. Ross

[57] ABSTRACT

The invention relates to a book holding device for holding the pages of a book in an open position for reading. The device consists of two support bars connected at a pivotal joint. Each support bar carries a slide bar spaced therefrom by stop clips. Each slide bar carries a book clip which may slide along the slide bar to adjust for different book sizes. Provision is also made for folding the device for storage. One of the slice bars is hingedly mounted to its support bar such that the book clip can be removed from the slide bar. The other support bar is formed as a hollow housing to allow the device to be folded after the book clip has been removed.

1 Claim, 4 Drawing Figures

POCKET PAGE HOLDER

BACKGROUND OF THE INVENTION

The invention relates to book holding devices, specifically, those types of book holders which maintain the pages of a book in open position for reading. Various prior art devices of this type are known, including devices which are adjustable to accommodate a range of book sizes and/or which fold for easy storage.

SUMMARY OF THE INVENTION

The instant invention consists of two support bars connected end-to-end at a pivotal joint. Each support bar carries a slide bar spaced therefrom by stop clips. Each slide bar carries a book clip which may slide along the length of the slide bar to adjust the book clips for various book sizes. Provision is also made for folding the invention for storage. One of the slide bars is hingedly mounted to its support bar such that the book clip can be removed from this slide bar. The other support bar is formed as a hollow housing to allow the invention to be folded after removal of the book clip.

DESCRIPTION OF THE PREFERRED EMBODIMENT

Figure 1:
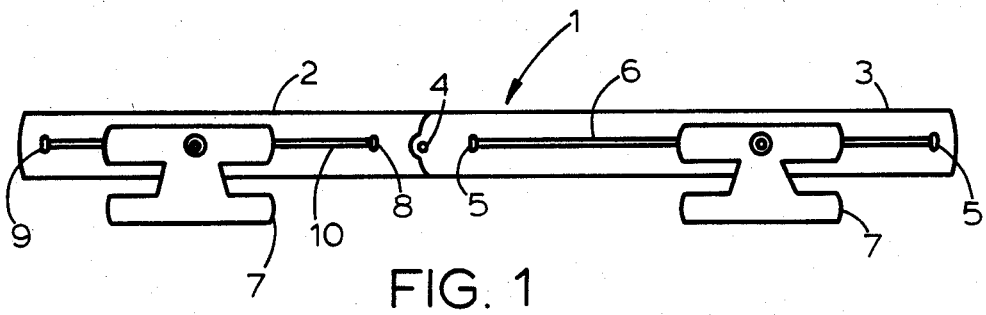
FIG. 1 is a top view of the pocket page holder in the open position.

With reference to the drawings, FIG. 1 shows the pocket page holder 1 of the instant invention. The holder consists of two support bars 2, 3, which are pivotally connected by a hinge 4. The support bars are preferably made of plastic, and may be of any desired color or colors. The support bars 2, 3 carry slide bars 6 and 10. The slide bars are mounted spaced from and parallel to the support bars by stop clips. Stop clips 5 mount slide bar 6, and stop clips 8 and 9 mount slide bar 10.

Book clips 7 are mounted upon the slide bars 6 and 10. The book clips may be of any conventional type and have spring-like mouths which can be opened to the combined width of the pages of the book to be held. The book clips 7 may slide along the slide bars to provide adjustment for different book sizes, the mounting of the book clips for sliding being of any common type.

Figure 2:
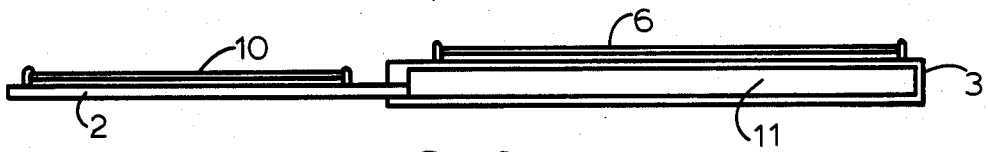
FIG. 2 is a front elevation of the pocket page holder in the open position and the book clips removed for clarity.
Figure 3:
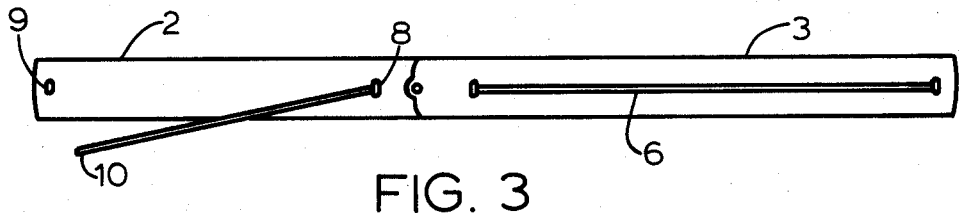
FIG. 3 is a top view of the pocket page holder in the open position with the book clips removed for clarity and the slide bar released.
Figure 4:
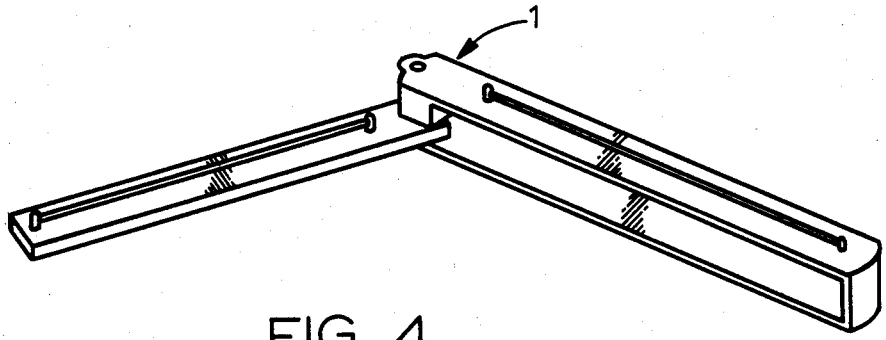
FIG. 4 is a perspective view of the pocket page holder in a partially closed position with the book clips removed for clarity.

One of the main features of the invention is the provision for folding, such that the device may be easily stored in a pocket or purse. As best shown in FIGS. 2 and 4, the support bar 3 is formed as a hollow housing such that support bar 2 may be folded into, and stored within, support bar 3. In order to allow this folding the book clip 7 mounted on slide bar 10 must first be removed. To this end the stop clips 8 and 9 are of a special type, specifically, stop clip 8 is a hinge stop clip and stop clip 9 is a snap-in stop clip. As shown in FIGS. 3 and 4, this allows the slide bar 10 to be released from snap-in stop clip 9 and pivoted away from the support bar 2 about hinge stop clip 8. With slide bar 10 in this position, the associated book clip 7 may be slid off the slide bar, thus allowing the folding of support bar. By following the reverse of this procedure the book clip may be re-mounted upon slide bar 10 when it is desired to use the pocket page holder.

The invention disclosed herein is not intended to be limited to the details set forth above, as obvious modifications will be apparent to those of ordinary skill in the art to which it pertains.

I claim:

1. A device for holding books in an open position for reading, said device comprising;

first and second support bars, each said support bar being elongated and pivotally mounted in end-to-end relationship by a hinge;

first and second book clips, each said book clip being mounted on a respective support bar for sliding movement therealong, and;

one of said book clips mounted on one of said support bar, the other said support bar being formed as a hollow housing such that, upon removal of said one book clip, said one support bar may be rotated about said hinge into said other support bar.

* * * * *